US009897393B2

(12) United States Patent
Lan

(10) Patent No.: US 9,897,393 B2
(45) Date of Patent: Feb. 20, 2018

(54) HEAT DISSIPATING MODULE

(71) Applicant: ASIA VITAL COMPONENTS CO., LTD., New Taipei (TW)

(72) Inventor: Wen-Ji Lan, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 27 days.

(21) Appl. No.: 15/166,275

(22) Filed: May 27, 2016

(65) Prior Publication Data

US 2017/0343296 A1 Nov. 30, 2017

(51) Int. Cl.
*F28D 15/00* (2006.01)
*F28D 15/04* (2006.01)

(52) U.S. Cl.
CPC ..... *F28D 15/04* (2013.01)

(58) Field of Classification Search
CPC ..... F28D 15/04; F28D 15/02; F28D 15/046; F28D 2015/0225; F28D 15/0233; H05K 7/20336
USPC ..... 165/104.26
See application file for complete search history.

(56) References Cited

U.S. PATENT DOCUMENTS 4,231,423 A * 11/1980 Haslett ..... F28D 15/0233 165/104.14
2004/0159422 A1* 8/2004 Zuo ..... F28D 15/046 165/104.14
2007/0272399 A1* 11/2007 Nitta ..... F28D 15/0233 165/185

* cited by examiner

*Primary Examiner* — Davis Hwu
(74) *Attorney, Agent, or Firm* — Jackson IPG PLLC; Demian K. Jackson

(57) ABSTRACT

The present invention relates to a heat dissipating module which comprises a first flat shell body and a plurality of second flat shell bodies. The first flat shell body has a first chamber and a first wick structure formed on an inner wall of the first chamber. Each of the second flat shell bodies defines a second chamber which is provided with a working fluid and a second wick structure therein. Each of the second flat shell bodies has a heat pipe plugged and connected to the first flat shell body. Therefore, the working fluid in each of the second chambers flows into the first chamber through the corresponding heat pipes to perform heat dissipation by liquid-vapor circulation.

12 Claims, 11 Drawing Sheets

HEAT DISSIPATING MODULE

BACKGROUND OF THE INVENTION

Field of the Invention

The present invention relates to a heat dissipating module and in particular to a heat dissipating module which is used for heat dissipation.

Description of Prior Art

As the current electronic equipment gradually having compact and lightweight design to meet customers' requirements, the sizes of the electronic components thereof decrease accordingly. When the electronic equipment shrinks, the accompanying heat creates the major barrier to the performance of electronic equipment and system improvement. Therefore, to effectively deal with the problem of heat dissipation of the components in the electronic equipment, the industry proposes the vapor chamber and heat pipe which have better performance of heat transfer to solve the present issue of heat dissipation.

The vapor chamber is a shell body (or planar body) having a rectangular shape. There are wick structures disposed on the chamber wall in the shell body and there is working liquid filled in the shell body. One side (i.e., evaporation region) of the shell body is attached to a heat generating device such as a CPU, a Northbridge, a Southbridge, a transistor, and a MCU to absorb the heat generated by the heat generating device such that the working liquid in the liquid state is vaporized in the evaporation region of the shell body to transform into the vapor state. In this way, the heat is transferred to the condensation region of the shell body. Then, the working liquid in the vapor state is cooled and condensed in the condensation region to transform into the working liquid in the liquid state which flows back to the evaporation region by gravity or wick structures to continue the liquid-vapor circulation. Thus, an effective effect of uniform-temperature heat dissipation is achieved.

The operating principle and theoretical structure of the heat pipe are the same as those of the vapor chamber. As for the vapor chamber, the hollow portion of its circular pipe is filled with metal powder (or woven mesh) to form a circular wick structure on the inner wall of the heat pipe by a sinter process. Then, the heat pipe is pumped down into a vacuum state and filled with a working liquid. Finally, the heat pipe is sealed to form a heat pipe structure. When the working liquid is heated in the evaporation region to vaporize, it diffuses to the condensation end. The working liquid in the evaporation region is in a vapor state. After it leaves the evaporation region and diffuses into the condensation end, it is gradually cooled and transformed into a liquid state. Then, the working liquid flows back to the evaporation region through the wick structure.

The difference between the vapor chamber and the heat pipe is the heat transfer type. The heat transfer type of the vapor chamber is two-dimensional and planar, while the heat transfer of the heat pipe is one-dimensional.

How to use these two types of heat transfer units more effectively is the target which the industry currently strives to reach.

SUMMARY OF THE INVENTION

Thus, to effectively overcome the above problems, one objective of the present invention is to provide a first flat shell body which is connected to a plurality of second flat shell bodies individually through a plurality of heat pipes such that the working fluids in the second flat shell bodies flow into the first flat shell body for heat dissipation.

Another objective of the present invention is to provide a first flat shell body disposed above the second flat shell bodies each of which is connected to and below the first flat shell body through a heat pipe such that the working fluids in the second flat shell bodies are heated to vaporize and flow into the first flat shell body to dissipate heat and then flow back to the second flat shell bodies from the first flat shell body by gravity and the wick structures.

Still another objective of the present invention is to provide a heat pipe having two open ends which are individually pressed against the inner side of the first chamber of the first flat shell body and the inner side of the second chamber of the second flat shell body such that a heat pipe wick structure of the heat pipe is connected to the first wick structure and the second wick structure through the open ends by a capillary connection.

Yet another objective of the present invention is to provide a heat pipe having two open ends extending to press against the inner sides of the two chambers of the first and second flat shell bodies. Two throughholes are individually disposed at two extension portions extending from the heat pipe into the two chambers such that the heat pipe channel of the heat pipe communicates with the two chambers.

Still yet another objective of the present invention is to provide a first flat shell body with a large heat dissipating area, which is connected to a plurality of second flat shell bodies with small heat absorbing areas through a plurality of heat pipes such that the working fluids in the second flat shell bodies can flow to the large dissipating area of the first flat shell body through the heat pipes to dissipate heat.

Another objective of the present invention is to provide a heat pipe whose pipe wall having an inner surface provided with a plurality of ribs disposed spacedly. A groove is disposed between each two adjacent ribs. The heat pipe wick structure is formed on the ribs and the grooves. Thus, the area of the heat pipe wick structure increases and the efficiency of the capillary channel of the heat pipe channel is enhanced.

Another objective of the present invention is to provide a heat pipe channel of a heat pipe. A supporting cylinder is disposed in the heat pipe channel and a cylindrical wick structure is disposed on the outer surface of the supporting cylinder. Thus, the supporting force between the first flat shell body and the second flat shell bodies can be enhanced through the heat pipes and the supporting cylinders. Also, the reflow capillary paths between the first chamber and the second chambers can be improved through the heat pipe wick structure and the cylindrical wick structure.

To achieve the above objectives, the present invention provides a heat dissipating module which comprises a first flat shell body and a plurality of second flat shell bodies. The first flat shell body defines a first chamber and has a plurality of first holes communicating with the first chamber; the first chamber has a first wick structure. Each of the second flat shell bodies defines a second chamber and has at least one second hole communicating with the second chamber; the second flat shell body is provided with a working fluid and a second wick structure therein. Each of the second flat shell bodies is connected to the first flat shell body through a heat pipe having a heat pipe channel and a heat pipe wick structure. The heat pipe channel is connected to the second chamber and the first chamber. The heat pipe wick structure is disposed in the heat pipe channel and connected to the first wick structure and the second wick structure by a capillary connection.

In one embodiment, the first flat shell body has a first outer top surface defining a heat dissipating area; each of the second flat shell bodies has a second outer bottom surface defining a heat absorbing area; the heat dissipating area of the first flat shell body is larger than the heat absorbing area of each of the second flat shell bodies.

In one embodiment, the first flat shell body has a first outer top surface defining a heat dissipating area; each of the second flat shell bodies has a second outer bottom surface defining a heat absorbing area; the heat dissipating area of the first flat shell body is larger than the sum of the absorbing areas of the second flat shell bodies.

In one embodiment, the first flat shell body is disposed above the second flat shell bodies.

In one embodiment, the second flat shell bodies are disposed to a left-and-right arrangement below the first flat shell body.

In one embodiment, the heat pipe has a pipe wall, a first extension portion, and a second extension portion opposite to the first extension portion. The first extension portion forms a first open end and the second extension portion forms a second open end. The heat pipe channel and the heat pipe wick structure are both disposed in the pipe wall and between the first open end and the second open end.

In one embodiment, the first extension portion extends from the first open end into the first chamber such that the first open end is pressed against the first wick structure on the top side in the first chamber; the second extension portion extends from the second open end into the second chamber such that the second open end is pressed against the second wick structure on the bottom side in the second chamber.

In one embodiment, the heat pipe wick structure is connected to the first wick structure and the second wick structure through the first open end and the second open end in a capillary way.

In one embodiment, the first extension portion and the second extension portion are provided with a first throughhole and a second throughhole, respectively, both penetrating through the pipe wall. The heat pipe channel communicates with the first chamber and the second chamber through the first throughhole and the second throughhole, respectively.

In one embodiment, the pipe wall has an inner surface facing the heat pipe channel and the inner surface is provided with a plurality of ribs disposed spacedly. A groove is disposed between each two adjacent ribs. The grooves and the ribs are interlaced with one another and extend along a longitudinal direction of the heat pipe.

In one embodiment, a supporting cylinder is disposed in the heat pipe channel and extends along a longitudinal direction of the heat pipe. Two opposite ends of the supporting cylinder are individually pressed against the first wick structure on the top side in the first chamber and the second wick structure on the bottom side in the second chamber.

In one embodiment, the supporting cylinder is made of metal and is provided with a cylindrical wick structure on an outer surface thereof.

In one embodiment, the supporting cylinder is made of metal sintered powder.

In one embodiment, the first flat shell body and the second flat shell bodies are vapor chambers or planar uniform-temperature heat pipes.

BRIEF DESCRIPTION OF DRAWING

The purpose of the following drawings is to make the present invention understood easily. The descriptions of the drawings will be detailed in the specification and incorporated to be part of the embodiments. Through the embodiments in the specification and reference to the corresponding figures, the embodiments of the present invention will be explained in detail and the operating theory will be described.

DETAILED DESCRIPTION OF THE INVENTION

The above objectives, structural and functional characteristics of the present invention will be described according to the preferred embodiments in the accompanying drawings.

The present invention provides a heat dissipating module which comprises a first flat shell body and a plurality of second flat shell bodies. The first flat shell body has first chamber having a first wick structure formed on an inner wall of the first chamber. Each of the second flat shell bodies defines a second chamber. The second chamber has a working fluid and a second wick structure therein. Each of the second flat shell bodies is connected to and below the first flat shell body through a heat pipe. Each second chamber communicates with the first chamber through the corresponding heat pipe. The working fluid in each of the second chambers flows into the first chamber through the corresponding heat pipe to dissipate heat and then flows back to the second chamber through the corresponding heat pipe.

The embodiments of the present invention will be detailed below in reference to the accompanying drawings, the reference signs, and the explanation thereof.

Figure 1A:
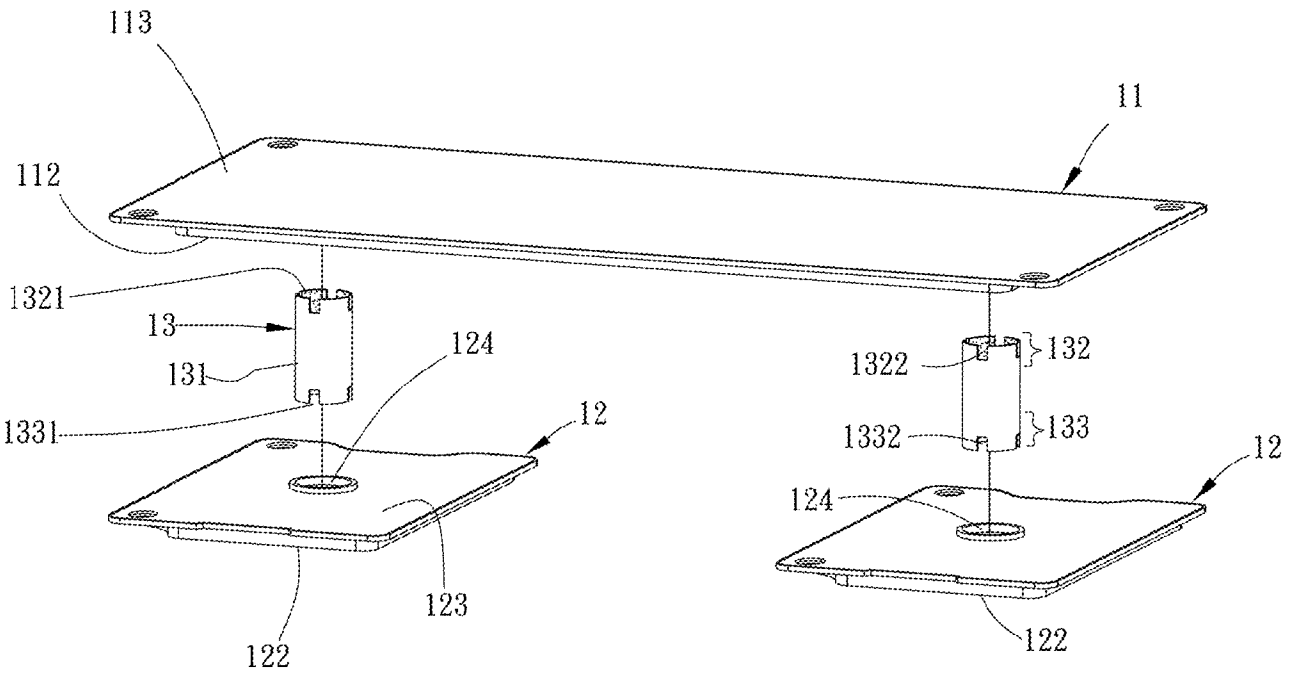
FIG. 1A is a perspective exploded view of the present invention.

FIG. 1A is a perspective exploded view of the present invention.

Figure 1B:
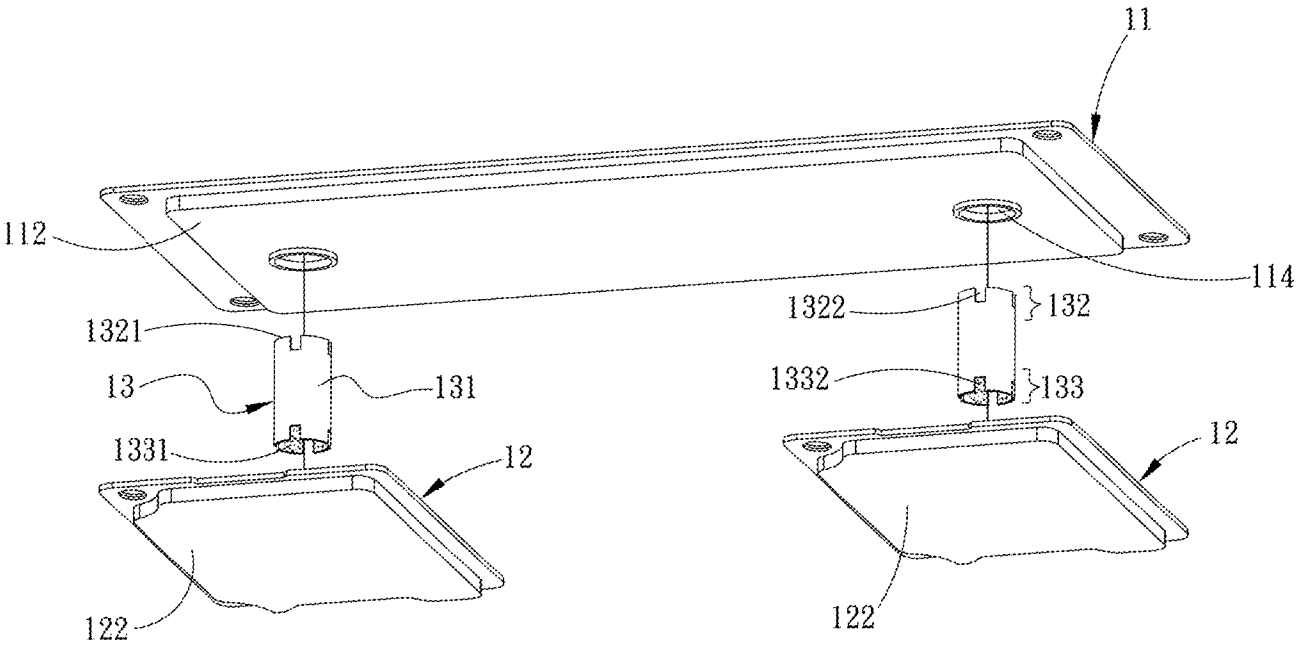
FIG. 1B is a perspective exploded view of the present invention from another view.
Figure 2:
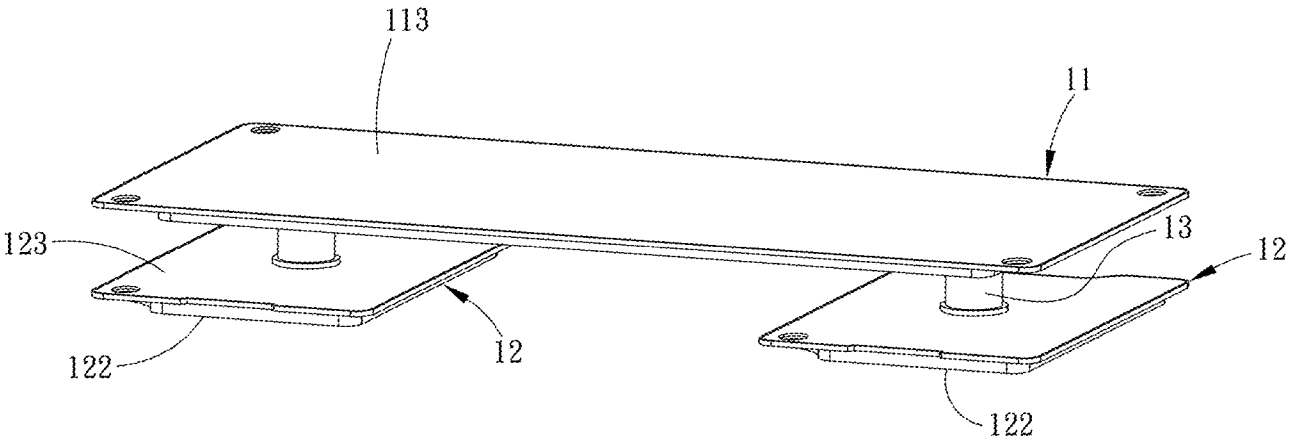
FIG. 2 is a perspective assembled view of the present invention.
Figure 3A:
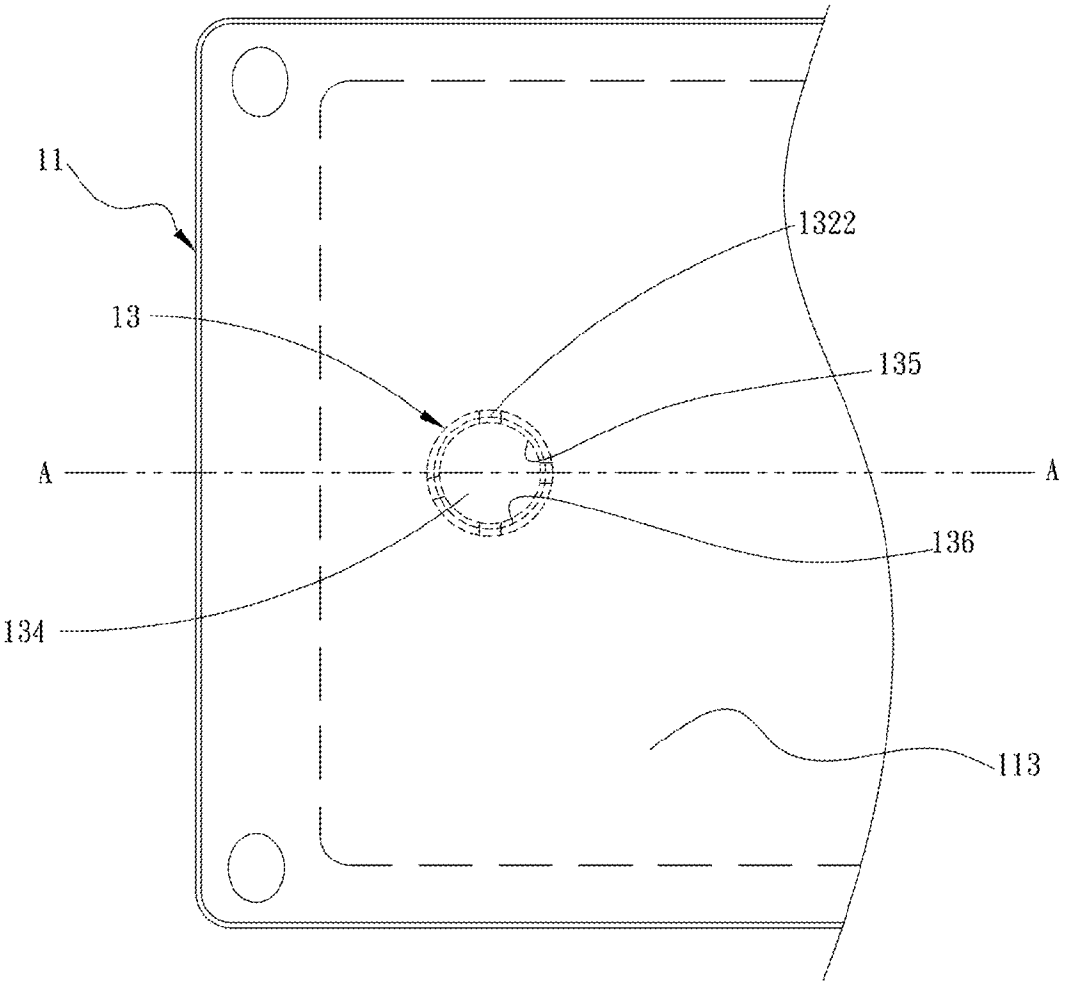
FIG. 3A is a partial top view of the present invention.
Figure 3B:
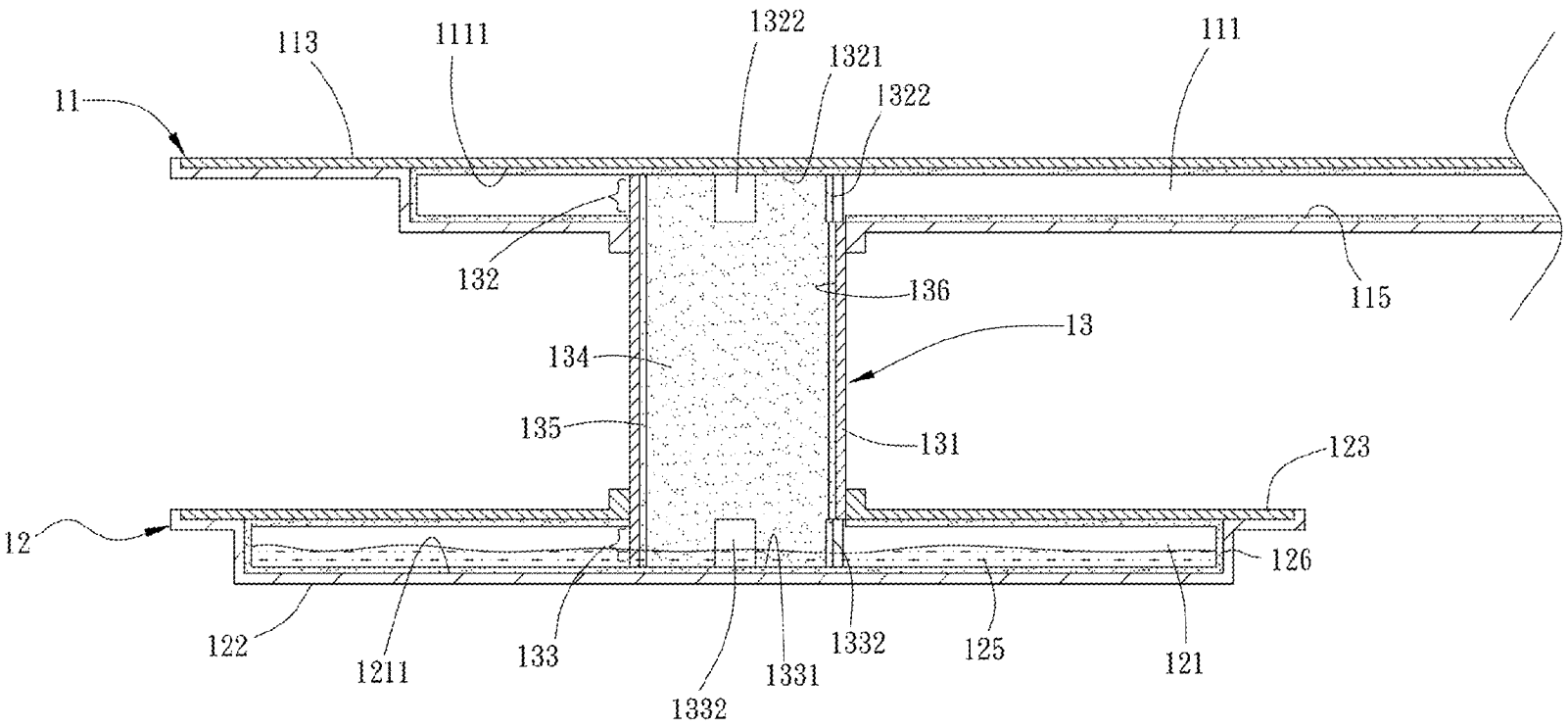
FIG. 3B is a partial cross-sectional view of the present invention.

FIG. 1B is a perspective exploded view of the present invention from another view. FIG. 2 is a perspective assembled view of the present invention. FIG. 3A is a partial top view of the present invention. FIG. 3B is a partial cross-sectional view of the present invention. As shown in the above figures, a heat dissipating module comprises a first flat shell body 11 and a plurality of second flat shell bodies 12. The first flat shell body 11 is disposed above the second flat shell bodies 12. In the current embodiment, there are two second flat shell bodies 12 disposed to a left-and-right arrangement below the first flat shell body 11. The first flat shell body 11 and the second flat shell bodies 12 are preferably made of metal with high heat conductivity such as gold, silver, copper, or the alloy thereof. The first flat shell body 11 and the second flat shell bodies 12 are physically embodied as vapor chambers or planar uniform-temperature heat pipes.

The interior of the first flat shell body 11 defines a first chamber 111. The first flat shell body 11 has a first outer bottom surface 112, a first outer top surface 113, and a plurality of first holes 114 penetrating through the bottom surface 112 and communicating with the first chamber 111. A first wick structure 115 is disposed on an inner wall of the first chamber 111. The first chamber 111 has a top side 1111 spaced with the first holes 114 correspondingly. The first outer top surface 113 is used for heat dissipation and defines a heat dissipating area. The heat dissipating area is the surface area of the first outer top surface 113. For example, the first outer top surface 113 shown in FIG. 1A is a rectangle and its surface area equals the product of the length and the width of the first outer top surface 113. In another embodiment, if the first outer top surface 113 is a circle, its surface area equals the product of 3.14 and the radius squared.

The interior of each of the second flat shell bodies 12 defines a second chamber 121. The second flat shell body 12 has a second outer bottom surface 122 facing the first outer bottom surface 112 of the first flat shell body 11 and a second outer top surface 123 provided with at least one second hole 124 communicating with the second chamber 121. The second chamber 121 is provided with a working fluid 125 and a second wick structure 126 therein. The second wick structure 126 is disposed on the inner wall of the second chamber 121. The second chamber 121 has a bottom side 1211 spaced with the second hole 124 correspondingly. Each of the second flat shell bodies 12 is connected to the first flat shell body 11 through a heat pipe 13 such that the second chambers 121 individually communicate with the first chamber 111 of the first flat shell body 11 through the corresponding heat pipes 13. The second outer bottom surface 122 in FIGS. 1A and 1B is a surface protruding downward and used for heat absorption and defines a heat absorbing area. The heat absorbing area is the surface area of the second outer bottom surface 122. For example, the second outer bottom surface 122 shown in FIG. 1B is a rectangle and its surface area equals the product of the length and the width of the second outer bottom surface 122. In another embodiment, if the shape of the second outer bottom surface 122 is a circle, then its surface area equals the product of 3.14 and the radius squared.

In a preferred embodiment, the heat dissipating area of the first flat shell body 11 is larger than the heat absorbing area of each of the second flat shell bodies 12. In another preferred embodiment, the heat dissipating area of the first flat shell body 11 is larger than the sum of the absorbing areas of the second flat shell bodies 12.

The heat pipe 13 has a pipe wall 131, a first extension portion 132, and a second extension portion 133 opposite to the first extension portion 132. The first extension portion 132 forms a first open end 1321 and the second extension portion 133 forms a second open end 1331. The heat pipe channel 134 and the heat pipe wick structure 135 are both disposed in the pipe wall 131 and between the first open end 1321 and the second open end 1331. The first extension portion 132 of the heat pipe 13 extends from the first open end 114 into the first chamber 111 such that the first open end 1321 is pressed against the first wick structure 115 on the top side 1111 in the first chamber 111. Further, the heat pipe wick structure 135 at the first open end 1321 is connected to the first wick structure 115 on the top side 1111 by a capillary connection. Also, the first open end 1321 is closed by the top side 1111 in the first chamber 111.

Besides, the second extension portion 132 of the heat pipe 13 extends from the second open end 124 into the second chamber 121 such that the second open end 1331 is pressed against the second wick structure 126 on the bottom side 1211 in the second chamber 121. Further, the heat pipe wick structure 135 at the second open end 1331 is connected to the second wick structure 126 on the bottom side 1211 in a capillary connection. Also, the second open end 1331 is closed by the bottom side 1211 in the second chamber 121.

The first extension portion 132 and the second extension portion 133 of the heat pipe 13 are provided with a first throughhole 1322 and a second throughhole 1332, respectively, both penetrating through the pipe wall 131. The heat pipe channel 134 communicates with the first chamber 111 and the second chamber 121 through the first throughhole 1322 and the second throughhole 1332, respectively.

Figure 4A:
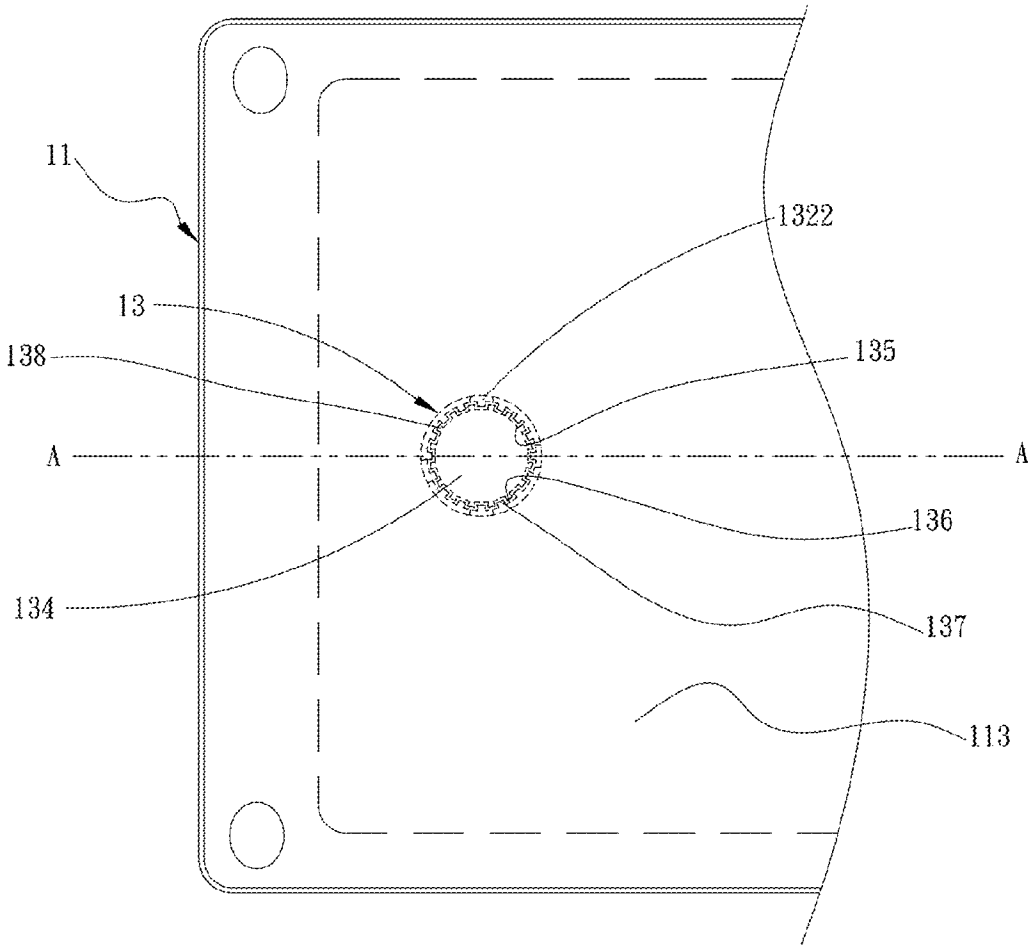
FIG. 4A is a partial top view of the heat pipe according to an alternative embodiment of the heat pipe of the present invention.
Figure 4B:
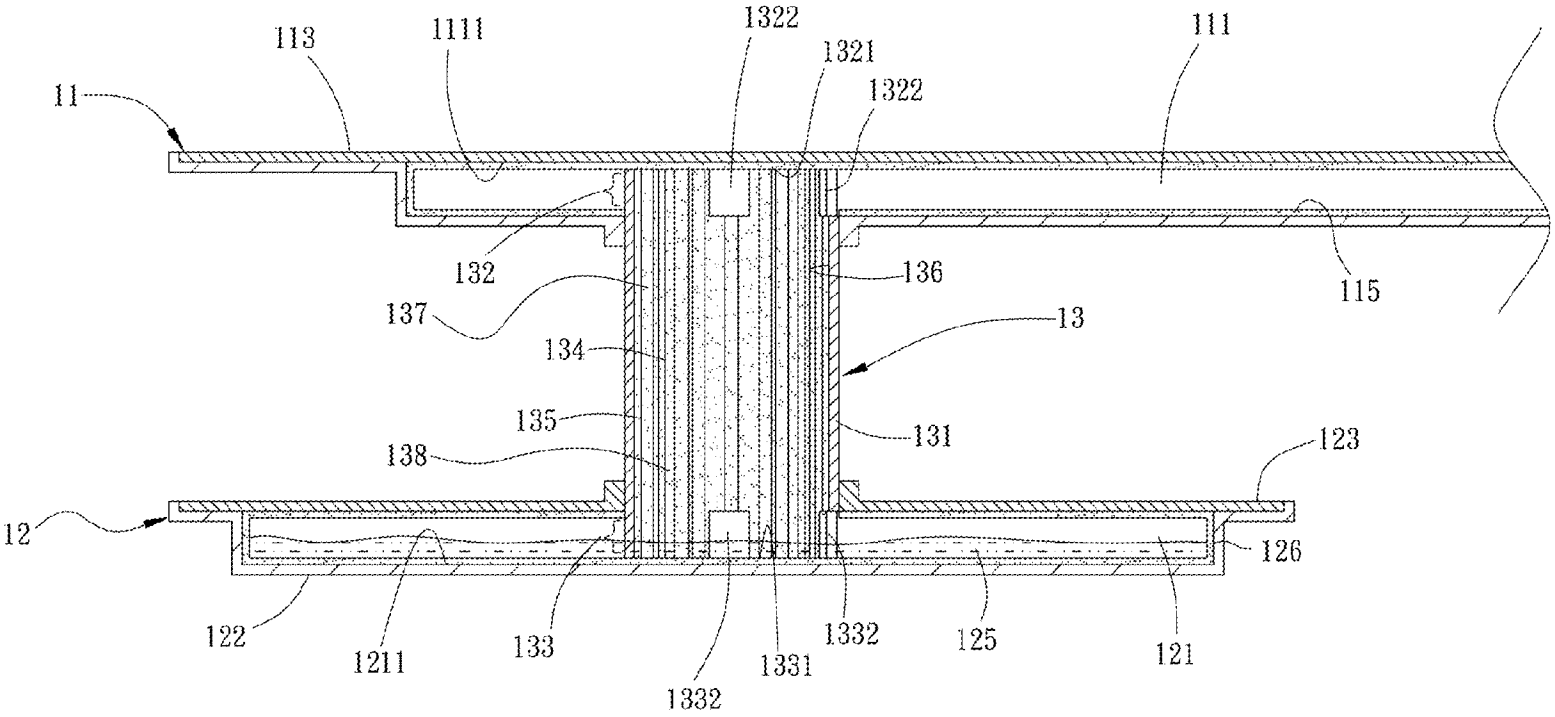
FIG. 4B is a partial cross-sectional view of the heat pipe according to an alternative embodiment of the heat pipe of the present invention.

In one embodiment, as shown in FIGS. 3A and 3B, the pipe wall 131 of the heat pipe 13 has an inner surface 136 facing the heat pipe channel 134. The inner surface 136 is an internal smooth and circular surface. The heat pipe wick structure 135 is disposed on the inner surface 136. However, in an alternative embodiment as shown in FIGS. 4A and 4B, the inner surface 136 is provided with a plurality of ribs 137 disposed spacedly and a groove 138 is disposed between each two adjacent ribs 137. The ribs 137 and the grooves 138 are interlaced with one another and extend along a longitudinal direction of the heat pipe 13. The heat pipe wick structure 135 is formed on the ribs 137 and the grooves 138. Thus, the area of the heat pipe wick structure 135 increases.

The first and second wick structures 115, 126 and the heat pipe wick structure 135 are made of a porous structure such as the metal sintered powder, woven mesh, groove, or fiber bundle, which can provide capillary force to drive the working fluid 125 to flow.

The term of "capillary connection" in the specification means that the first and second wick structures 115, 126 are physically touched by, pressed against, or connected to the heat pipe wick structure 135 such that the pores of the first and second wick structures 115, 126 communicate with those of the heat pipe wick structure 135. In this way, the capillary force can pass or deliver from the heat pipe wick structure 135 to the first and second wick structures 115, 126; the cooled working fluid 125 can flow back from the first chamber 111 to the second chamber 121 by the capillary force.

In operation, the second outer bottom surface 122 of each of the second flat shell bodies 12 touches a heat source such as a CPU, a MPU, a GPU, or other electronic components. The heat generated by each heat source is transferred to the corresponding second chamber 121 through the second outer bottom surface 122. The working fluid 125 in the second chamber 121 is heated and vaporized to transform into a vapor state and then flows through the second throughhole 1332 into the heat pipe channel 134 and then through the first throughhole 1322 into the first chamber 111. Then, the working fluid 125 dissipates the heat by means of the first outer top surface 113. After the working fluid 125 dissipates the heat, it transforms into a liquid state. Then, the working fluid 125 splits and flows to each heat pipe channel 134 by means of the capillary connection between the first wick structure 115 in the first chamber 111 and the heat pipe wick structure 135 at the first open end 1321 of the heat pipe 13. After that, the working fluid 125 flows back to the second open end 1331 of the heat pipe 13 by gravity and the capillary force of the heat pipe wick structure 135 and then flows back to the second chambers 121 by means of the capillary connection between the heat pipe wick structure 135 and the second wick structure 126. That is, the working fluid 125 in the plural second flat shell bodies 12 flows through the heat pipes 13 into the first flat shell body 11 to merge and dissipate the heat. After dissipating the heat, the working fluid 125 splits and flows back to the second flat shell bodies 12 from the first flat shell body 11 through the corresponding heat pipes 13.

Figure 5A:
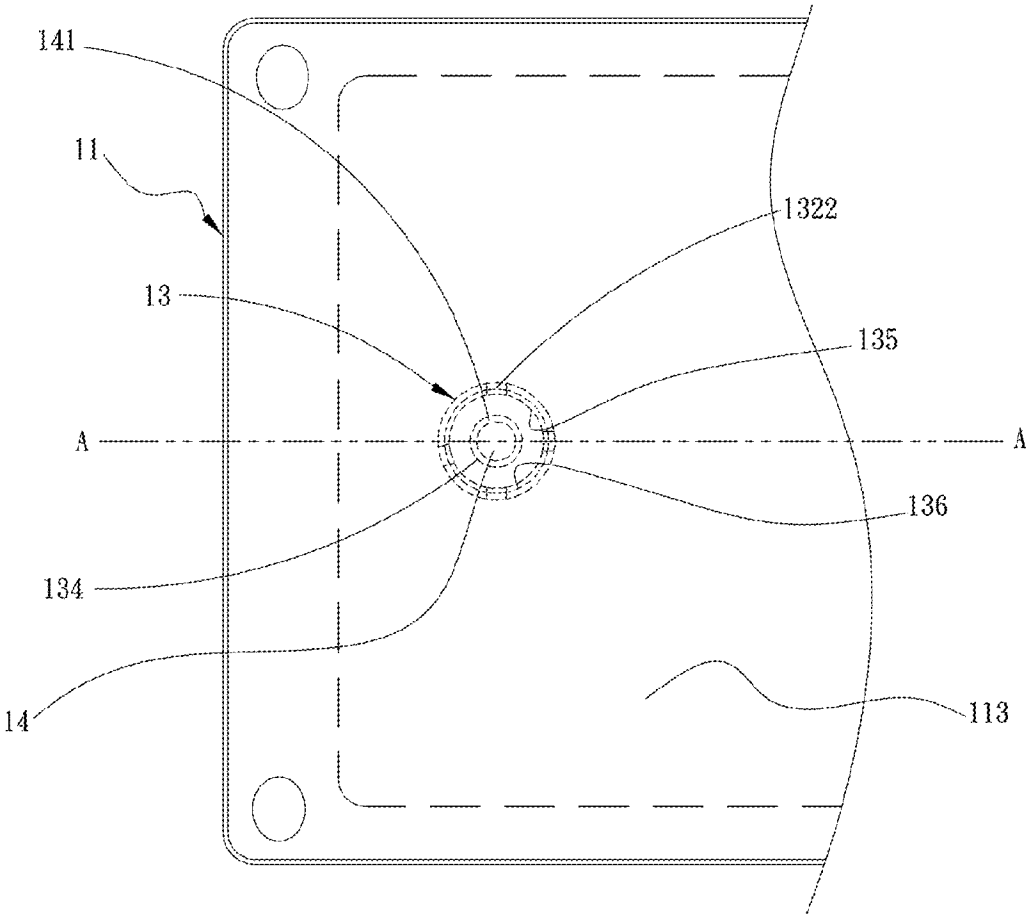
FIG. 5A is a partial top view of the heat pipe according to another alternative embodiment of the heat pipe of the present invention.
Figure 5B:
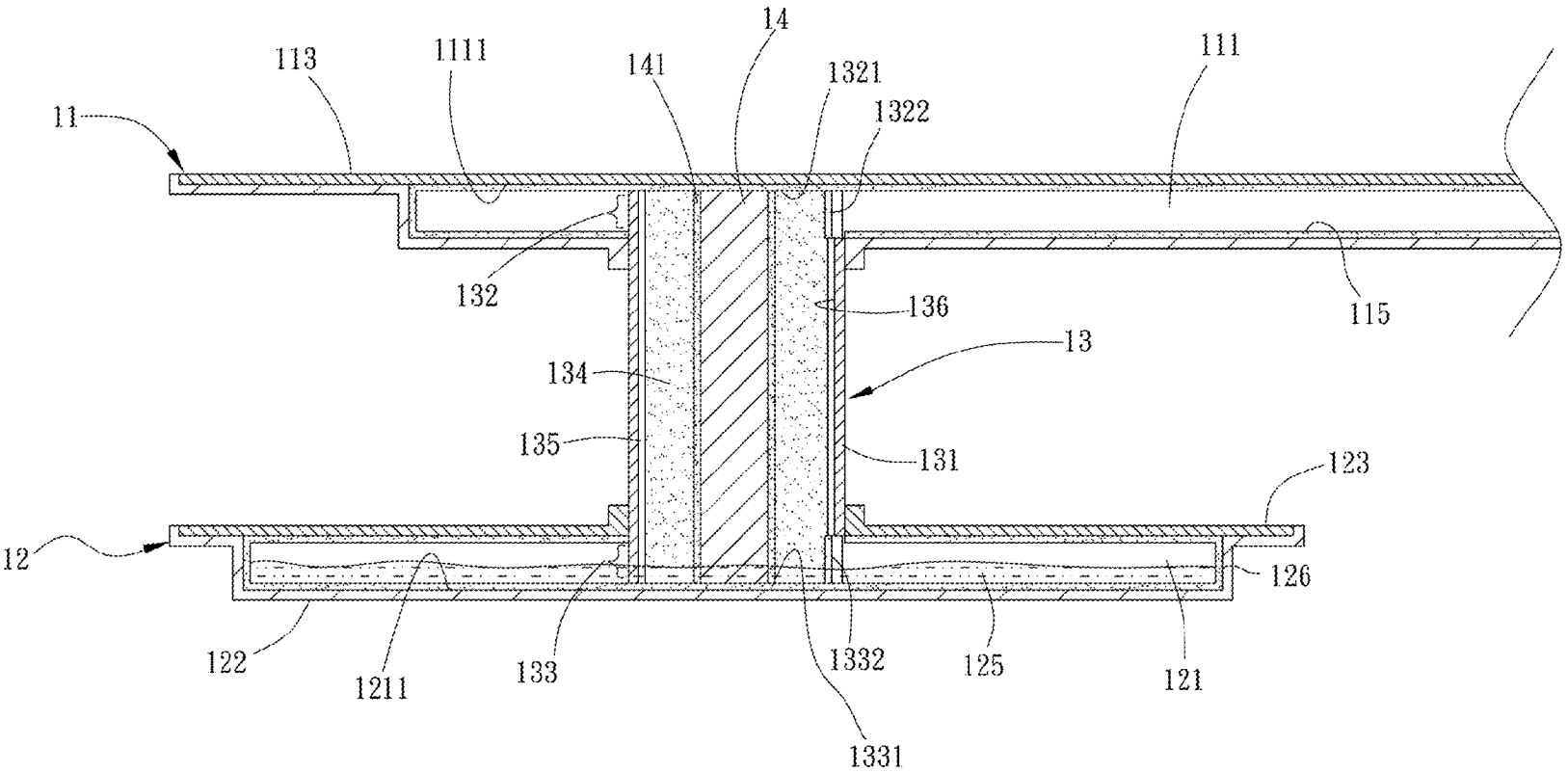
FIG. 5B is a partial cross-sectional view of the heat pipe according to another alternative embodiment of the heat pipe of the present invention.

In addition, FIGS. 5A and 5B show another alternative embodiment of the present invention. As shown in FIGS. 5A and 5B, a supporting cylinder 14 is disposed in the heat pipe channel 134 of the above-mentioned heat pipe 13 and extends along a longitudinal direction of the heat pipe 13. Two opposite ends of the supporting cylinder 14 are individually pressed against the top side 1111 in the first chamber 111 and the bottom side 1211 in the second chamber 121. The outer surface of the supporting cylinder 14 is provided with a cylindrical wick structure 141 made of metal sintered powder and/or grooves. The cylindrical wick structure 141 following the two opposite ends of the supporting cylinder 14 are individually pressed against the first wick structure 115 on the top side 1111 in the first chamber 111 and the second wick structure 126 on the bottom side 1211 in the second chamber 121. By means of such an arrangement, the heat pipes 13 and the supporting cylinders 14 are located between and support the first flat shell body 11 and the second flat shell bodies 12. Also, the cooled working fluid 125 in the first chamber 111 flows back to the respective second chambers 121 through the heat pipe wick structure 135 and the cylindrical wick structure 141.

The supporting cylinders 14 and the cylindrical wick structure 141 have preferably circular cross sections which are the same as that of the heat pipe 13 and the circular cross sections are concentric circles. The cross sectional diameter of the supporting cylinders 14 is preferably smaller than that of the heat pipe 13 and there is thus a channel space existing between the inner surface 136 of the pipe wall of the heat pipe 13 and the outer surface of the supporting cylinder 14 and the cylindrical wick structure 141 to allow the working fluid 125 to flow in the heat pipe channel 134. The above-mentioned supporting cylinder 14 is made of metal such as copper. However, in another alternative embodiment, the supporting cylinder 14 is made of metal sintered powder which itself is a wick structure and thus the above-mentioned cylindrical wick structure 141 can be omitted.

Figure 6A:
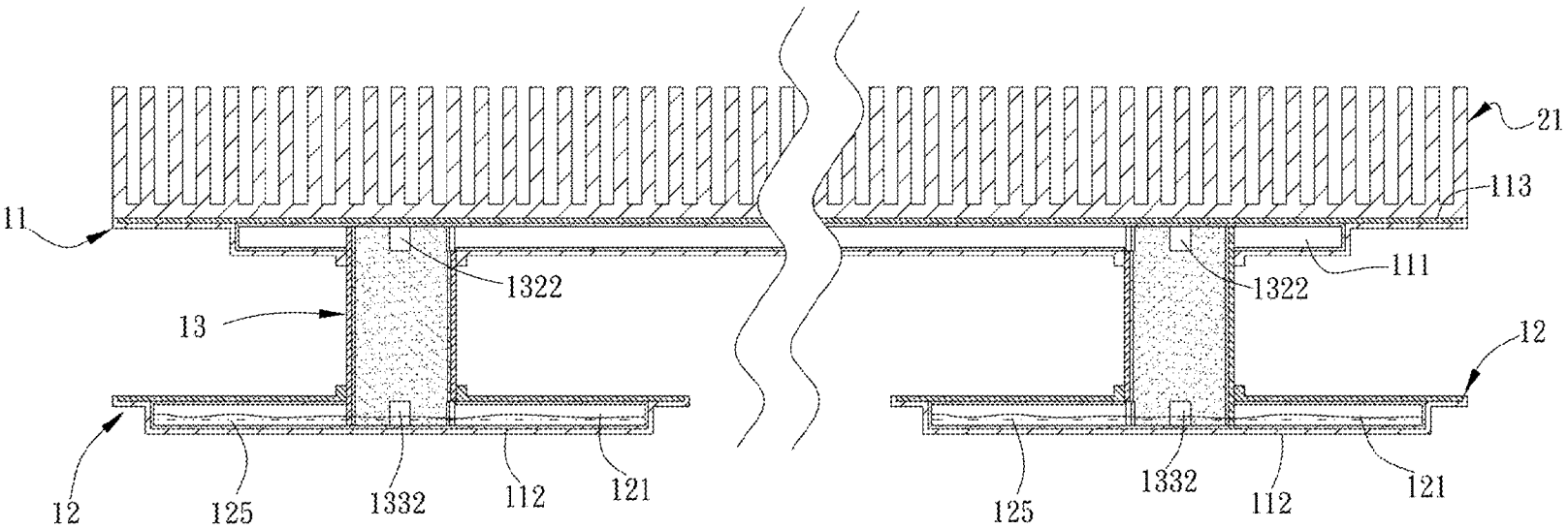
FIG. 6A is a cross-sectional view of the heat dissipating module according to the first embodiment of the present invention.
Figure 6B:
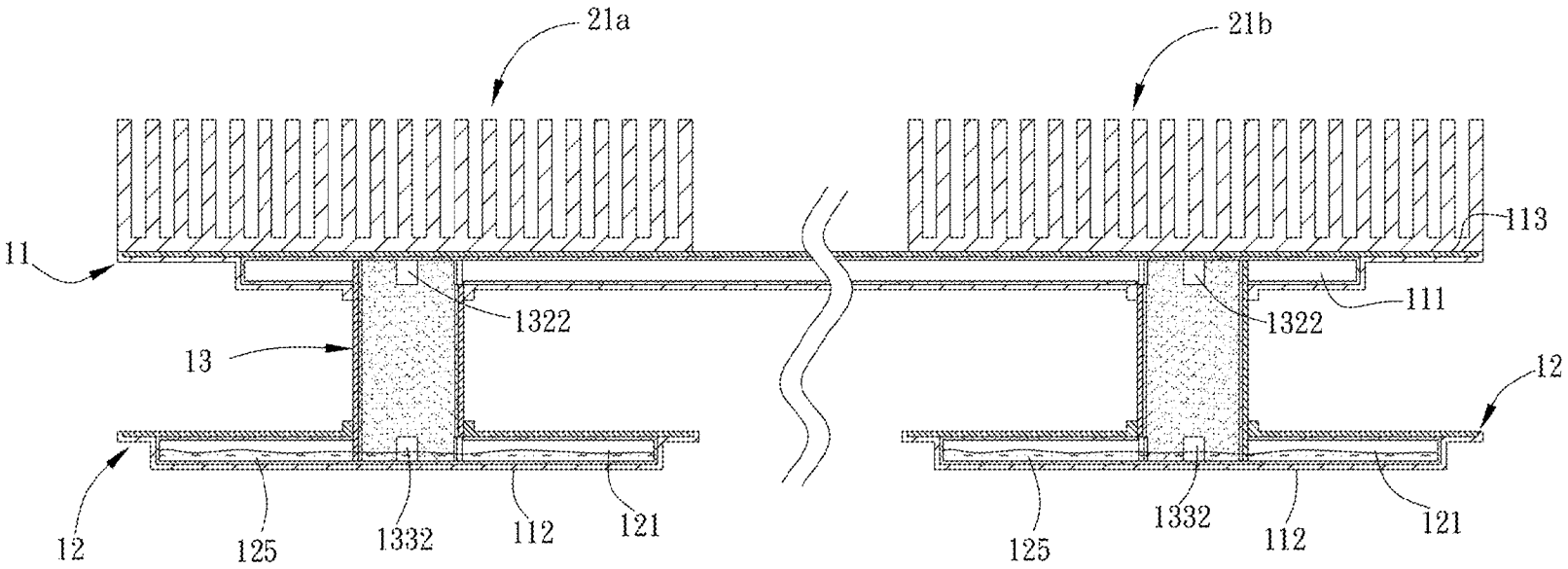
FIG. 6B is a cross-sectional view of the heat dissipating module according to another condition of the first embodiment of the present invention.

Please continue to refer to FIGS. 6A and 6B. The first outer top surface 113 of the first flat shell body 11 is selectively provided with a heat sink unit like a cooler or a fan; a heat sink 21 is disposed as shown in FIG. 6A in a preferred embodiment. However, in another embodiment, two heat sinks 21*a*, 21*b* are disposed on the first outer top surface 113 of the first flat shell body 11. These two heat sinks 21*a*, 21*b* are spaced to each other and individually correspond to two second flat shell bodies 12. Because each of the heat sinks 21, 21*a*, and 21*b* has plural fins to increase the contact area with air, the heat on the first outer top surface 113 can be dissipated quickly through the heat sinks 21, 21*a*, and 21*b*.

By means of the above arrangement, the working fluid 125 in each of the second flat shell bodies 12 flows into the first flat shell body 11 through the corresponding heat pipes 13 and dissipates the heat through the first outer top surface 113 of the first flat shell body 11 and then flows back to the second flat shell bodies 12 from the first flat shell body 11 through the heat pipes 13 by gravity and capillary force. Due to the dual effect of the gravity and capillary force, the reflow speed of the working fluid 125 increases. As a result, the liquid-vapor circulation is enhanced and the efficiency of the heat dissipation is thus enhanced. On the other hand, because the heat dissipating area of the first outer top surface 113 of the first flat shell body 11 is larger than the heat absorbing area of the second outer bottom surface 122 of each of the second flat shell bodies 12 or larger than the sum of the absorbing areas of the second flat shell bodies 12, after the working fluid 125 in the second flat shell bodies 12 merges and flows into the first flat shell body 11, the efficiency of the heat dissipation is further increased by means of the large heat dissipating area of the first shell body 11.

The above-mentioned embodiments are only the preferred ones of the present invention. All variations regarding the above method, shape, structure, and device according to the claimed scope of the present invention should be embraced by the scope of the appended claims of the present invention.

What is claimed is:

1. A heat dissipating module, comprising:

a first flat shell body defining a first chamber and having a plurality of first holes communicating with the first chamber, wherein the first chamber has a first wick structure disposed therein and a top side spaced with the first holes correspondingly; and a plurality of second flat shell bodies each defining a second chamber and having at least one second hole communicating with the second chamber, wherein the second chamber is provided with a working fluid and a second wick structure therein, wherein the second chamber has a bottom side spaced with the second hole correspondingly, wherein each of the second flat shell bodies is connected to the first flat shell body through a heat pipe having a heat pipe channel and a heat pipe wick structure, wherein the heat pipe channel is connected to the second chamber and the first chamber, wherein the heat pipe wick structure is disposed in the heat pipe channel and connected to the first wick structure and the second wick structure by a capillary connection, wherein the first flat shell body is disposed above the second flat shell bodies, wherein the second flat shell bodies are disposed to a left-and-right arrangement below the first flat shell body.

2. The heat dissipating module according to claim 1, wherein the first flat shell body has a first outer top surface defining a heat dissipating area, wherein the each of the second flat shell bodies has a second outer bottom surface defining a heat absorbing area, wherein the heat dissipating area of the first flat shell body is larger than the heat absorbing area of the each of the second flat shell bodies.

3. The heat dissipating module according to claim 1, wherein the first flat shell body has a first outer top surface defining a heat dissipating area, wherein the each of the second flat shell bodies has a second outer bottom surface defining a heat absorbing area, wherein the heat dissipating area of the first flat shell body is larger than the sum of the absorbing areas of the second flat shell bodies.

4. The heat dissipating module according to claim 1, wherein the heat pipe has a pipe wall, a first extension portion, and a second extension portion opposite to the first extension portion, wherein the first extension portion forms a first open end and the second extension portion forms a second open end, wherein the heat pipe channel and the heat pipe wick structure are both disposed in the pipe wall and between the first open end and the second open end.

5. The heat dissipating module according to claim 4, wherein the first extension portion extends from the first open end into the first chamber such that the first open end is pressed against the first wick structure on the top side in the first chamber, wherein the second extension portion extends from the second open end into the second chamber such that the second open end is pressed against the second wick structure on the bottom side in the second chamber.

6. The heat dissipating module according to claim 5, wherein the heat pipe wick structure is connected to the first wick structure and the second wick structure through the first open end and the second open end by the capillary connection.

7. The heat dissipating module according to claim 6, wherein the first extension portion and the second extension portion are provided with a first throughhole and a second throughhole, respectively, both penetrating through the pipe wall, wherein the heat pipe channel communicates with the first chamber and the second chamber through the first throughhole and the second throughhole, respectively.

8. The heat dissipating module according to claim 7, wherein the pipe wall has an inner surface facing the heat pipe channel and the inner surface is provided with a plurality of ribs disposed spacedly, wherein a groove is disposed between each two adjacent ribs, wherein the grooves and the ribs are interlaced with one another and extend along a longitudinal direction of the heat pipe.

9. The heat dissipating module according to claim 1, wherein a supporting cylinder is disposed in the heat pipe channel and extends along a longitudinal direction of the heat pipe, wherein two opposite ends of the supporting cylinder are individually pressed against the first wick structure on the top side in the first chamber and the second wick structure on the bottom side in the second chamber.

10. The heat dissipating module according to claim 9, wherein the supporting cylinder is made of metal and is provided with a cylindrical wick structure on an outer surface thereof.

11. The heat dissipating module according to claim 9, wherein the supporting cylinder is made of metal sintered powder.

12. The heat dissipating module according to claim 1, wherein the first flat shell body and the second flat shell bodies are vapor chambers or planar uniform-temperature heat pipes.

* * * * *